United States Patent [19]

Holloway

[11] Patent Number: 4,854,398

[45] Date of Patent: Aug. 8, 1989

[54] LOCATING DEVICES FOR SOIL DISPLACEMENT HAMMERS

[76] Inventor: David E. Holloway, Wern House, Mount Street, Gowerton, West Glamorgan, United Kingdom

[21] Appl. No.: 176,935

[22] Filed: Apr. 4, 1988

[30] Foreign Application Priority Data

Mar. 2, 1987 [GB] United Kingdom ..... 8707936
Nov. 20, 1987 [GB] United Kingdom ..... 8727218

[51] Int. Cl.[4] ..... E21B 47/024

[52] U.S. Cl. ..... 175/45; 175/19; 340/855

[58] Field of Search ..... 175/19, 21, 45, 62, 175/61; 340/855, 825.23, 680; 455/40

[56] References Cited

U.S. PATENT DOCUMENTS

| | | | |
|---|---|---|---|
| 3,746,106 | 7/1973 | McCullogh et al. | 340/855 X |
| 4,674,579 | 6/1987 | Geller et al. | 175/45 |
| 4,684,946 | 8/1987 | Issenmann | 340/855 |
| 4,694,913 | 9/1987 | McDonald et al. | 175/61 |

FOREIGN PATENT DOCUMENTS

| | | | |
|---|---|---|---|
| 129696 | 2/1978 | Fed. Rep. of Germany | 175/45 |
| 152209 | 3/1961 | U.S.S.R. | 175/45 |
| 2134152 | 8/1984 | United Kingdom . | |
| 2147035 | 8/1984 | United Kingdom . | |
| 8703924 | 7/1987 | World Int. Prop. O. . | |

*Primary Examiner*—Stephen J. Novosad
*Assistant Examiner*—David J. Bagnell
*Attorney, Agent, or Firm*—David P. Gordon

[57] ABSTRACT

A locating device for a soil displacement hammer is disclosed and comprises a cylindrical, radio wave-transparent housing which is releasably connected between an air line for the soil displacement hammer (mole) and the hammer itself so as to permit air communication through the housing. Mounted along the axis of the housing is a cylindrical radio wave transmitter, such that, when the hammer is driven through the ground by repeated pneumatic impact, its location under the ground can be detected at the surface.

20 Claims, 2 Drawing Sheets

LOCATING DEVICES FOR SOIL DISPLACEMENT HAMMERS

BACKGROUND

The present invention relates to locating devices for soil displacement hammers.

Soil displacement hammers (commonly referred to as "moles") are increasingly employed for laying underground pipes, cables or conduits underneath a roadway or the like, without the need for excavating a continuous trench and therefore without disturbing the surface or causing disruption to traffic.

Conventional soil displacement hammers are powered by compressed air and operate as follows. A pit or trench is dug at one side of the area to be bored under and the soil displacement hammer is set up and aimed in the direction of the desired cable or pipe run. Compressed air is applied such that the mole bores the cable or pipe hole. Retrieval of the mole may be achieved by digging a corresponding pit at the opposite side of the area being traversed. Soil displacement hammers of this type are described in, for example, Great Britain Specifications Nos. 2,134,152 and 2,147,035, and PCT Specification No. WO87/03924.

Soil displacement hammers are intended to be driven through the ground by repeated pneumatic impact with, typically, 400 to 700 pneumatic impacts per minute in use. They are not intended to be rotatably driven nor to transmit torque, and therefore cannot function as drilling bits which are alternative tools for boring underground tunnels or the like.

While soil displacement hammers operate extremely effectively and will normally cope with small obstructions such as tree roots, stones and the like, larger obstructions can deflect the tool from its predicted course making it difficult to retrieve. One proposal for overcoming the problem has been to attach a radio sonde to the compressed air hose behind the mole by means of waterproof tap or hose clips. However, in practice, such a sonde is not without drawbacks as its shape and the fact that it is asymmetrically located on the hose, give rise to obstruction problems.

The use of a radio transmitter within a housing provided in line with a rotatably driven boring bit has been previously proposed in, for example, U.S. Pat. No. 3,746,106. However, such a boring bit locator cannot easily be adapted for use in a soil displacement hammer, as will now be explained. The only major requirements for the bit locator for a rotatably driven boring bit are that it should be capable of transmitting rotary motion and should permit passage of water to facilitate the cutting action of the boring bit. In contrast, a radio transmitter within a housing provided in line with a soil displacement hammer would be required to permit air to flow therethrough with little or no constriction or disturbance to the air flow, in order that the pneumatic drive transferred to the striker or anvil of the hammer is not adversely affected. It is probably for this reason that the previously proposed solution to the problem of using a radio transmitter with a soil displacement hammer has been to attach the transmitter externally to the compressed air hose.

SUMMARY OF THE INVENTION

It is therefore an object of the invention to provide a locating device for a soil displacement hammer.

It is a further object of the invention to provide a locating device for a soil displacement hammer which is symmetrically located relative to a hose and which does not obstruct the air flow to the hammer.

In accord with the objects of the invention, an improved locating device for a soil displacement hammer is provided, and generally comprises a substantially axially symmetrical, radio transparent housing adapted to be fitted between an air line for the hammer and the hammer itself. Mounted substantially along the center axis of the housing is an axially symmetrical radio transmitter. The mounting of the transmitter and the transmitter itself are arranged to permit air communication through the housing.

Preferably, the housing of the improved locating device is cylindrical in shape and of the same external diameter as the air line to which it is to be attached. Also, the housing preferably includes an end fitting allowing it to be releasably connected, at one end to the mole itself, and the other end to the air line.

The material from which the housing is made is not critical provided that it is sufficiently durable for the conditions to which it will be exposed, while being sufficiently transparent to radio waves which allow the signal generated by the transmitter to be detected above the surface of the ground. For these reasons stainless steel is the preferred material.

A better understanding of the improved locating device for the soil displacement hammer of the present invention, and additional advantages and objects of the invention will become apparent to those skilled in the art upon reference to the detailed description and accompanying drawings where like numerals refer to like parts.

DETAILED DESCRIPTION OF THE PREFERRED EMBODIMENT

Figure 1:
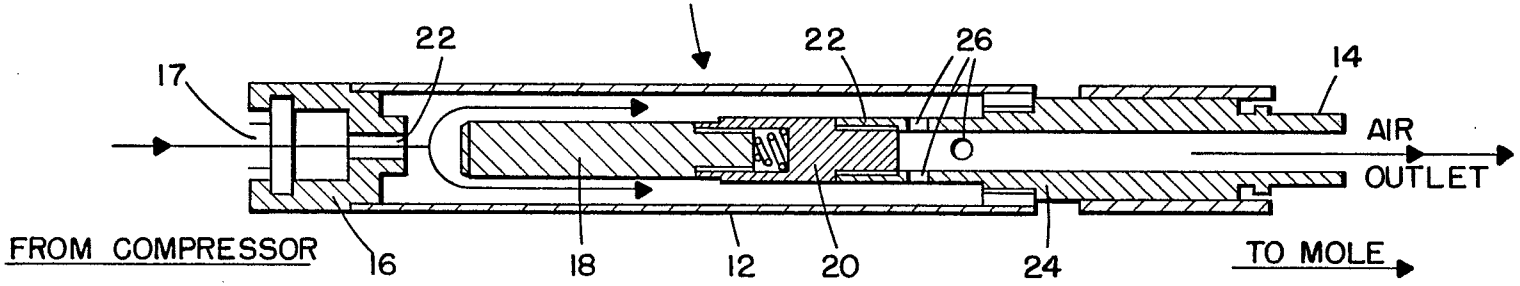
FIG. 1 is an axial sectional view of a first embodiment of a locating device according to the invention.

Referring to FIG. 1, a locating device generally designated 10 comprises a cylindrical housing 12 adapted to be connected to a horizontal soil displacement hammer (not shown in the drawings) by male end fitting 14 and to a compressed air line by female end fitting 16 having a central bore 17.

Within the housing 12 is a radio transmitter or signal unit 18 mounted on a central boss 20, which is itself preferably mounted at the end 22 of an air conduit 24 in such a manner as to close the end 22. A series of apertures 26 are arranged around the end 22 of conduit 24. In the embodiment illustrated, four apertures 26 (three shown) are symmetrically arranged at ninety degree spacings around the axis of conduit 24.

In use, air from the compressor (not shown) passes into the housing 12 via bore 17 and around the radio transmitter 18 and boss 20. The air then passes through apertures 26 and into conduit 24 from where it passes out of the locating device 10 and into the soil displacement hammer or mole (not shown).

Figure 2:
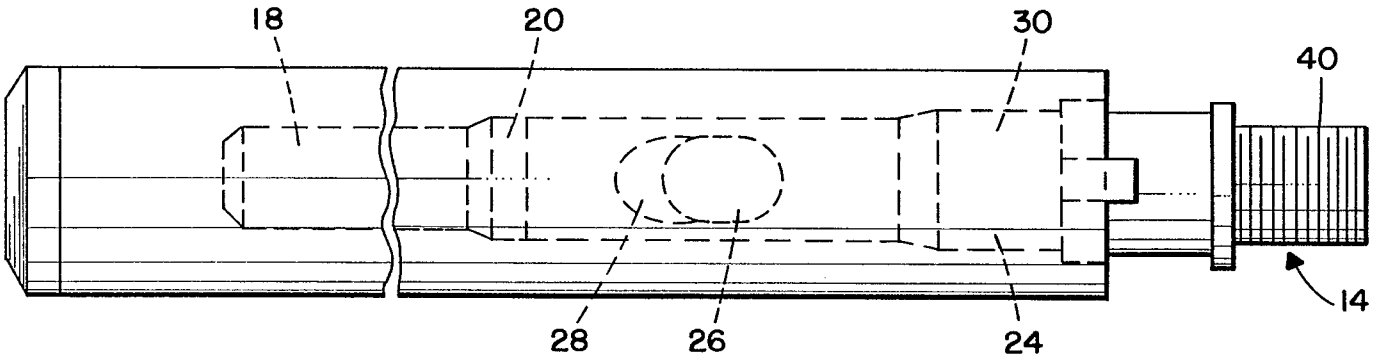
FIG. 2 is a side elevation of a modification of the device of FIG. 1.

Turning to FIG. 2, the radio transmitter 18, hose 20 and air conduit 24 of a modified locating device of the invention are shown in phantom lines. Two apertures 26 are provided in conduit 24, these being spaced by one hundred and eighty degrees. The apertures have bevelled ends 28 which taper outwardly in the direction of the radio transmitter 18; i.e., in the upstream direction relative to the predominant direction of air flow through the housing 12 and conduit 24). The bevelled ends 28 of apertures 26 can be seen more clearly in FIG. 3. In accord with the embodiment of FIGS. 2 and 3, conduit 24 has a tapered section 30 the diameter of which increases in the downstream direction.

Figure 3:
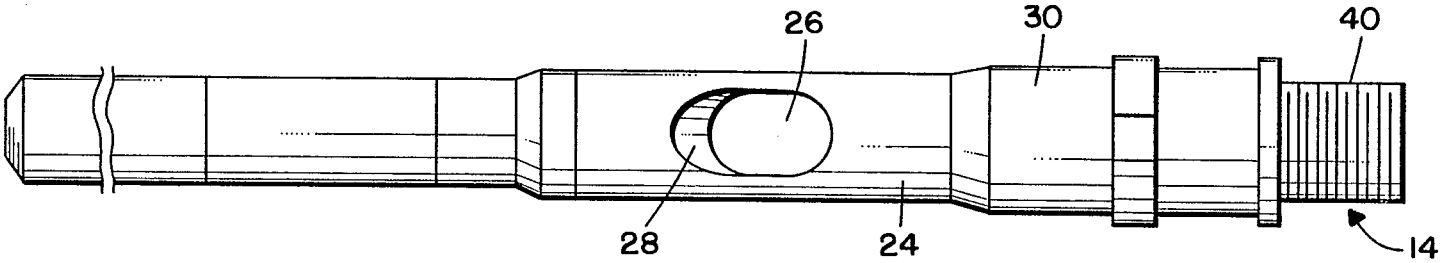
FIG. 3 is a more detailed view showing the radio transmitter and its mounting in the embodiment of FIG. 2.
Figure 4:
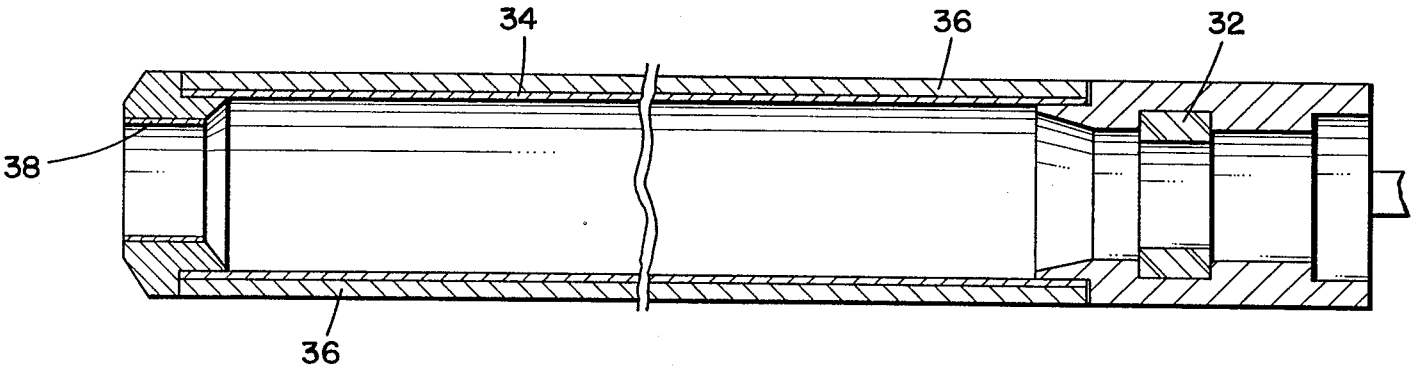
FIG. 4 is a more detailed sectional view of the housing for the radio transmitter in the embodiment of FIG. 2.

Referring to FIG. 4, an annular rubber seal 32 is shown and is provided internally of the housing 12 to engage the enlarged diameter section 30 of conduit 24 (shown in FIG. 3). The housing 12 of the locating device 10 has a main, generally cylindrical portion 34, constructed from a durable material which is sufficiently transparent to radio waves so as to allow the signal generated by the transmitter to be detected above the surface of the ground. Stainless steel meets these requirements and is the preferred durable material. External to housing 12, is a replaceable close-fitting wear-resistant sheath 36 preferably comprised of a heat-shrunk plastics material such as a heat-shrunk polyethylene. As seen in FIGS. 2–4, the housing 12 preferably terminates on one end in a female end fitting 16 which is provided with an internal thread 38, and on the other end with a male end fitting 14 provided with an external thread 40.

In use, the compressed air hose (not shown) is disconnected from the mole (not shown). The locating device 10 is then connected via male thread 40 to the mole and via female thread 38 to the compressed air line. The mole is then used in the conventional manner. The position of the mole can be located at the ground surface using a suitable receiver, of which many are available commercially. If desired, the depth of mole can be monitored (continuously, or at desired times) to ensure that it will not conflict with existing drains or other utility lines in the area. Should the mole be deflected in use, its position can be detemined so that an appropriate retrieval trench can be dug. Thus, it will be appreciated that the provided locating device according to the invention is simple to use and eliminates the problems of obstruction in the hole being bored.

There has been described and illustrated herein locating devices for soil displacement hammers. While particular embodiments of the invention have been described, it is not intended that the invention be limited thereby, as it is intended that the invention be as broad in scope as the art will allow. Thus, for example, while the locating device was described as having a boss on which the transmitter is mounted itself mounted at the end of the exiting air conduit, it will be appreciated that other arrangements could be had provided the transmitter is axially symmetrically mounted in the housing of the locating device and does not substantially restrict the flow of air through the device. Therefore, it will be apparent to those skilled in the art that yet other changes and modifications may be made to the invention as described without departing from the scope of the invention as so claimed.

I claim:

1. A locating device for a soil displacement hammer for boring through an earth formation in a manner substantially parallel to the surface of the earth formation, comprising:

(a) a substantially axially symmetrical, substantially radio wave transparent housing adapted to be fitted between an air line for said hammer and said hammer itself so as to permit air communication through said housing; and (b) a substantially axially symmetrical radio transmitter mounted in said housing substantially along the axis thereof for transmitting radio signals which are used to locate the location of said soil displacement hammer in said earth formation.

2. A locating device according to claim 1, wherein: said housing is substantially cylindrical in shape.

3. A locating device according to claim 2, wherein: said housing has substantially the same external diameter as said air line to which it is to be attached.

4. A locating device according to claim 3, further comprising:

(c) end-fittings for releasably conntecting said locating device at one end to said soil displacement hammer and at another end to said air line.

5. A locating device according to any of claims 4, wherein:

said housing is comprised of stainless steel.

6. A locating device according to claim 5, wherein: said housing is provided around it periphery with a replaceable wear-resitant sheath.

7. A locating device according to claim 4, further comprising:

(a) an air conduit secured in a substantially air-tight manner at one end of said housing, said conduit having at least two apertures permitting air communication between the interior of said housing and said air conduit, wherein said radio transmitter is mounted at a blind end of said air conduit.

8. A locating device according to claim 7, wherein: said apertures are symmetrically spaced around said air conduit.

9. A locating device according to claim 5, wherein: each of said apertures has a chamfered edge arranged to be substantially parallel to flow of air from said housing to said air conduit.

10. A locating device according to claim 5, wherein: said housing is comprised of stainless steel and is provided around its periphery with a replaceable wear-resistant sheath.

11. A locating device according to claim 9, wherein: said air conduit is arranged with said end-fitting for connecting said locating device to said hammer.

12. A locating device according claim 1, further comprising:

(c) end-fittings for releasably connecting said locating device at one end to said soil displacement hammer and at another end to said air line.

13. A locating device according to claim 1, further comprising:

(c) an air conduit secured in a substantially air-tight manner at one end of said housing, said conduit having at least two apertures permitting air communicaton between the interior of said housing and said air conduit, wherein said radio transmitter is mounted at a blind end of said air conduit.

14. A locating device according to claim 13, wherein:

said apertures are symmetrically spaced around said air conduit.

15. A locating device according to claim 14, wherein: each of said apertures has a chamfered edge arranged to be substantially parallel to flow of air from said housing to said air conduit.

16. A locating device according to claim 8, wherein: said housing is comprised of stainless steel and is provided around its periphery with a replaceable wear-resistant sheath.

17. A locating device according to claim 7, wherein: said air conduit is arranged with an end-fitting for connecting said locating device to said hammer.

18. A locating device according to claim 1, wherein: said housing is comprised of stainless steel and is provided around its periphery with a replaceable wear-resistant sheath.

19. A locating device for a soil displacement hammer, comprising:

(a) a substantially axially symmetrical, substantially radio wave transparent cylindrical housing for connection between an air line for said hammer and said hammer itself and adapted to permit air communication through said housing, wherein said housing has substantially the same external diameter as said air line;

(b) an air conduit secured in a substantially air-tight manner at one end of said housing, said conduit having at least two apertures permitting air communication between the interior of said housing and said air conduit;

(c) a substantially axially symmetrical radio transmitter mounted substantially at a blind end of said air conduit in said housing substantially along the axis of said housing; and (d) end-fittings for releasably connecting said locating device at one end to said soil displacement hammer and at another end to said air line.

20. A locating device according to claim 19, wherein: said apertures are symmetrically spaced around said air conduit, and are provided with a chamfered edge arranged to be substantially parallel to flow of air from said housing to said air conduit, and said housing is comprised of stainless steel and is provided around its periphery with a replaceable wear-resistant sheath.

* * * * *